US008099798B2

(12) United States Patent
Gaffney

(10) Patent No.: US 8,099,798 B2
(45) Date of Patent: Jan. 24, 2012

(54) PIVOTAL PLATE SUSPENSION SYSTEM

(76) Inventor: James Gaffney, Muskego, WI (US)

( * ) Notice: Subject to any disclaimer, the term of this patent is extended or adjusted under 35 U.S.C. 154(b) by 343 days.

(21) Appl. No.: 12/470,301

(22) Filed: May 21, 2009

(65) Prior Publication Data

US 2010/0293701 A1 Nov. 25, 2010

(51) Int. Cl.
*A41F 19/00* (2006.01)

(52) U.S. Cl. ..... 2/334; 2/340

(58) Field of Classification Search ..... 2/340, 310, 2/79, 227, 69, 81, 326–334, 336–338; 24/318–319; 182/3–4; 244/151 R
See application file for complete search history.

(56) References Cited

U.S. PATENT DOCUMENTS 727,796 A * 5/1903 Hine ..... 2/334
752,777 A * 2/1904 Humphery ..... 2/317
2,262,688 A * 11/1941 Lozo ..... 24/319
3,473,201 A * 10/1969 Hopka et al. ..... 24/632
4,850,057 A 7/1989 Schierenbeck
4,967,421 A * 11/1990 Grilliot et al. ..... 2/327
5,129,105 A * 7/1992 Kleinman ..... 2/328
5,448,779 A 9/1995 Aldridge
5,477,997 A * 12/1995 Weatherly ..... 224/44.5
5,691,028 A 11/1997 Curtis
6,167,573 B1 1/2001 Lewis
6,668,434 B2 * 12/2003 Casebolt et al. ..... 24/634
6,698,031 B2 3/2004 Lewis
2005/0274388 A1 * 12/2005 Kosh ..... 128/869
2006/0195962 A1 * 9/2006 Jordan ..... 2/69
2006/0230504 A1 * 10/2006 Razzaghi et al. ..... 2/338

* cited by examiner

*Primary Examiner* — Gary L Welch
*Assistant Examiner* — Khaled Annis
(74) *Attorney, Agent, or Firm* — Absolute Technology Law Group, LLC

(57) ABSTRACT

A pivotal suspension system to support lower-body protective gear which is constructed from pivotally attached plates increasing the wearer's range of motion in hazardous situations.

9 Claims, 4 Drawing Sheets

PIVOTAL PLATE SUSPENSION SYSTEM

FIELD OF INVENTION

This invention relates generally to the field of protective clothing and more specifically to a pivotal suspension system for protective lower body gear.

BACKGROUND

The U.S. market for protective clothing is currently valued at about $2.3 billion per year and is expected to increase to more than $3.35 billion by 2010, rising at an average annual growth rate (AAGR) of 7.9%.

Firefighters' protective clothing accounts for more than half the value of this sector. Bunker gear or "turnout gear" are terms used by many firefighters to refer to their system of outer protective clothing, reflecting that pants and boots are traditionally kept by the firefighter's bunk at the fire station to be readily available for use.

The protective clothing market sector is expected to increase by approximately 8% through 2010, and the market for fire resistant gear is expected to reach slightly over $1.6 billion by 2010.

Protective heat-resistant overalls are standard protective gear that are purchased by forestry, military, and other management and or safety personnel.

While a one-piece protective suit may be used in certain safety professions, the difficulty in fitting a protective suit coveralls to the wearer's body proportions and the difficulty in putting on such clothing quickly are limiting factors. Accordingly, U.S. National Fire Protection Association (NFPA) standards mandate a combination of fire-resistant overalls and a jacket. The loose fitting nature of the overalls ("turn out pants") are easier to put on and less likely to affect a user's range of motion. Some firefighters and safety personnel hang the turn out pants in an upright position over their boots to allow them to dress more quickly. For example, the turnout pants, when not in use, may be stored scrunched down around the boots for efficient and fast access when they are needed. The firefighter may then step into each boot and pull up the pants and suspenders.

According to NFPA standards and similar standards in other countries, all turnout clothing must be comprised of three components: an outer shell, a moisture barrier, and a thermal barrier. In between these layers are pockets of air referred to as "dead zones". These layers of air along with the three protective layers help to further insulate the wearer from the extreme environments of fires.

Turn out pants often have a storage function. Firefighters and other safety personnel must carry various tools and equipment as well as rope they may need during an emergency.

Suspenders used with turn out pants must be of a heavy duty type in order to hold the turn out pants in place against the weight of tools, or when the pants are wet.

It is desirable that suspenders used with protective overalls be designed in a manner which minimizes slippage of straps, secures the overalls on the body, and does not impede movement or response capability of the wearer.

SUMMARY OF THE INVENTION

The invention disclosed herein is an apparatus to support the weight or turnout pants and other protective body wear without restricting the fire fighter's range of motion. The apparatus disclosed herein is comprised of a substantially flat, substantially rigid and friction-resistant upper slotted plate having a horizontal slot and at least one aperture adapted to receive a rivet. The apparatus further includes a substantially flat, substantially rigid and friction-resistant lower slotted plate having two angled slots and a second aperture adapted to receive a rivet which is pivotally mounted to the upper slotted plate by a rivet.

The angles of the upper slotted plate may positioned at an angle of 30 to 70 degrees above a horizontal axis measured with reference to a horizontal and the center point of said double slotted lower plate placed generally in the upper one-third portion of the upper slotted plate. The upper and lower slotted plates may be constructed of plastic or of materials having friction-reducing and heat resistant qualities.

Further embodiments of the invention may include a diagonally folded strap inserted within said upper slotted upper plate with a folded strap having a first upper strap buckle attached at a first end of said diagonally folded strap and a second upper strap buckle attached at said second end of said diagonally folded strap, said upper slotted plate securing said diagonally folded strap in a substantially flattened position.

Still other embodiments of the invention may include hook-and-loop fabric straps and elasticized straps, and additional plastic loops, rivets, clasps, pockets, ties, and securing members known in the art. Various embodiments may include loops, pockets, hooks and straps of plastic or other materials from which various devices and accessories used or known in the safety profession may be suspended.

GLOSSARY

As used herein, the term "protective pants" or "turnout pants" means any pants or trousers which are constructed of a material and for the purposes of protecting a wearer from fire, heat, toxic substances, debris or other hazards encountered which make lower body protection desirable. As used herein, protective pants may consist of garments other than pants or trousers, such as skirts, drapes, or other lower-body protective garments.

As used herein, the term "rivet" means a structure for pivotally attaching two plates having apertures. For example, a rivet may be comprised of a substantially smooth or threaded cylindrical shaft with a head (protuberance) on each end which holds the shaft in place.

As used herein, the term "semi-rigid" means a non-brittle material from which a support structure may be constructed and which can withstand movement or bending without cracking.

As used herein, the term "diagonally-folded strap" means folded in a manner so that two portions of a strap form a 30-60 degree angle.

As used herein, the term "securing member" means any structure adapted to receive a clasp. A securing member may include, but is not limited to, a snap, button, hook, tie, protuberance or other structure adapted to be secured to a clasp or metal loop.

As used herein, the term "clasp" means a loop or other structure permanently or selectively fixed to a strap adapted to attach the strap to a securing member on an article of clothing.

As used herein, the term "strap buckle" means any means known in the art for securing a strap including but not limited to a loop, single slotted structure, double slotted structure, slide metal, corset buckle, carabineer, latch, claw hook, or square loop. A strap buckle may be constructed of metal, plastic wood or any other resilient rigid or semi-rigid structure.

As used herein, the term "hook and loop fabric" means two adjoining fabric layers consisting of a "hook" side covered with "tiny hooks" and a "loop" side, which is also covered with even smaller loops. When the two sides are pressed together, the hooks catch in the loops and hold the pieces together.

DETAILED DESCRIPTION OF EMBODIMENTS OF THE INVENTION

Figure 1:
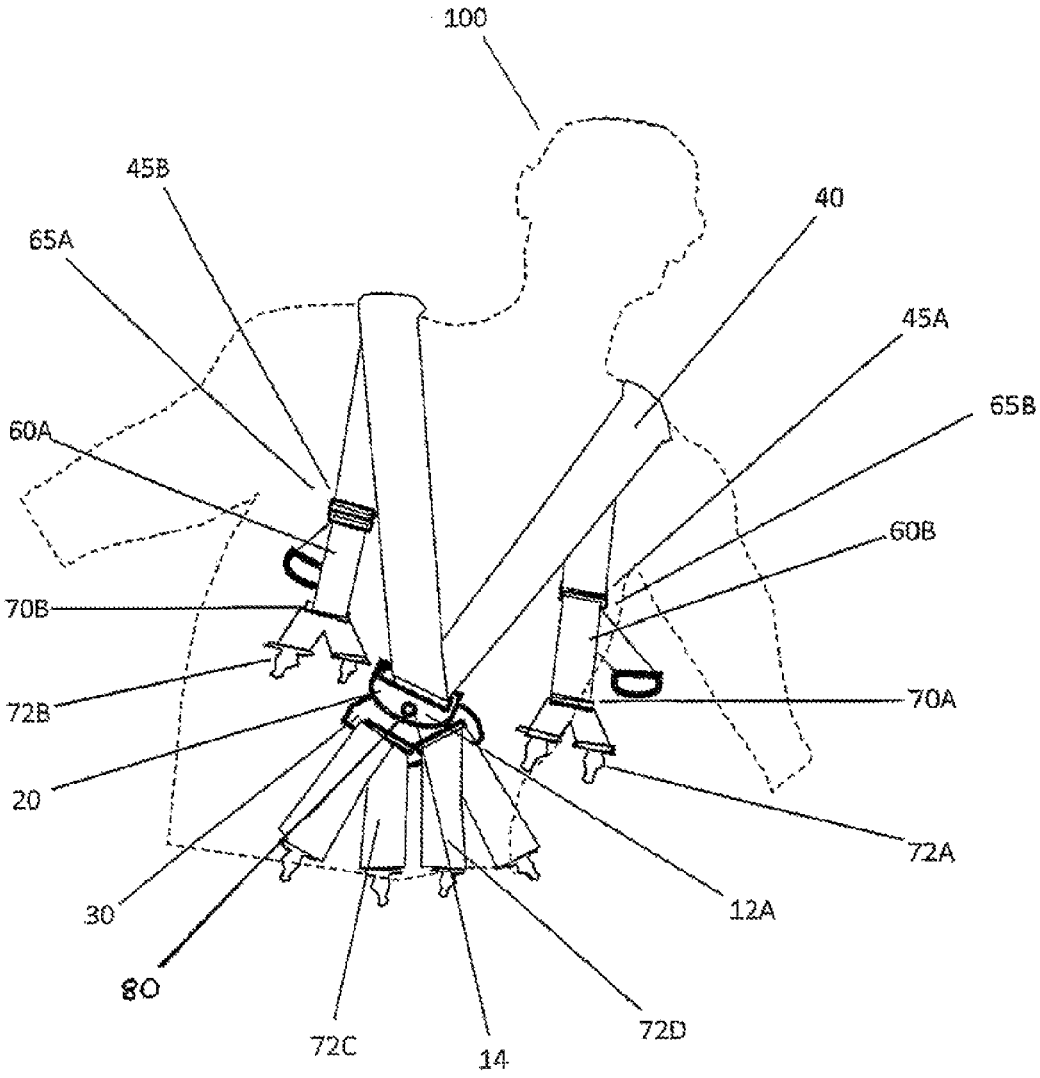
FIG. 1 is an exemplary embodiment of a pivotal support suspension system.

For the purpose of promoting an understanding of the present invention, references are made in the text hereof to embodiments of a pivotal plate suspension system, only some of which are depicted in the figures. It should nevertheless be understood that no limitations on the scope of the invention are thereby intended. One of ordinary skill in the art will readily appreciate that modifications such as the dimensions, size, and shape of the components, alternate but functionally similar materials from which elements of the pivotal plate suspension system disclosed herein are made, and the inclusion of additional elements (in particular additional system parts or modifications to system parts that perform an equivalent function) are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related.

DETAILED DESCRIPTION OF DRAWINGS

For the purpose of promoting an understanding of the present invention; references are made in the text to exemplary embodiments of a pivotal suspension system only some of which are described herein. It should be understood that no limitations on the scope of the invention are intended by describing these exemplary embodiments. One of ordinary skill in the art will readily appreciate that modifications such as the dimensions of a pivotal suspension system, alternate but functionally similar material(s) from which the pivotal suspension system may be made. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the pivotal suspension system as disclosed herein may be comprised of a single multi-dimensional and/or textured component, while others may include multiple multi-dimensional and/or textured components.

FIG. 1 illustrates an exemplary embodiment of pivotal plate suspension system 100 used with protective pants to increase the range of motion and better secure the clothing of safety personnel. Upper slotted plate 20, in the embodiment shown, is a substantially flat, substantially rigid and friction-resistant upper slotted plate having horizontal slot 12A and a first aperture 14 adapted to receive a rivet 80.

FIG. 1 further illustrates lower slotted plate 30 which is also a substantially flat, substantially rigid and friction-resistant slotted plate having two angled slots 16A, 16B (shown in FIG. 1*b*). Lower slotted plate 30 includes a second aperture adapted to receive a rivet 80. Lower slotted plate 30 is pivotally mounted to upper slotted plate 20. In the embodiment shown, upper slotted plate 20 may be positioned (pivoted) at a forty-five to seventy-degree angle relative to lower slotted plate 30.

FIG. 1 further illustrates a diagonally folded strap 40 having a first upper strap buckle 45A attached at a first end of diagonally folded strap 40 and a second upper strap buckle 45B attached at the opposite (second end) of diagonally folded strap 40, said upper slotted plate 20 securing diagonally folded strap 40 in a substantially flattened position.

FIG. 1 further illustrates hook-and-loop fabric strap 60A threaded through upper strap buckle 65A. A second hook-and-loop fabric strap 60B threaded through said second upper strap buckle 65A. The first hook-and-loop fabric strap is attached to a first lower strap buckle 70A and said second hook-and-loop fabric strap is attached to a second lower strap buckle 70B. Clasps 72A and 72B secure pivotal plate suspension system 100 to protective clothing in the embodiment shown.

Figure 2A:
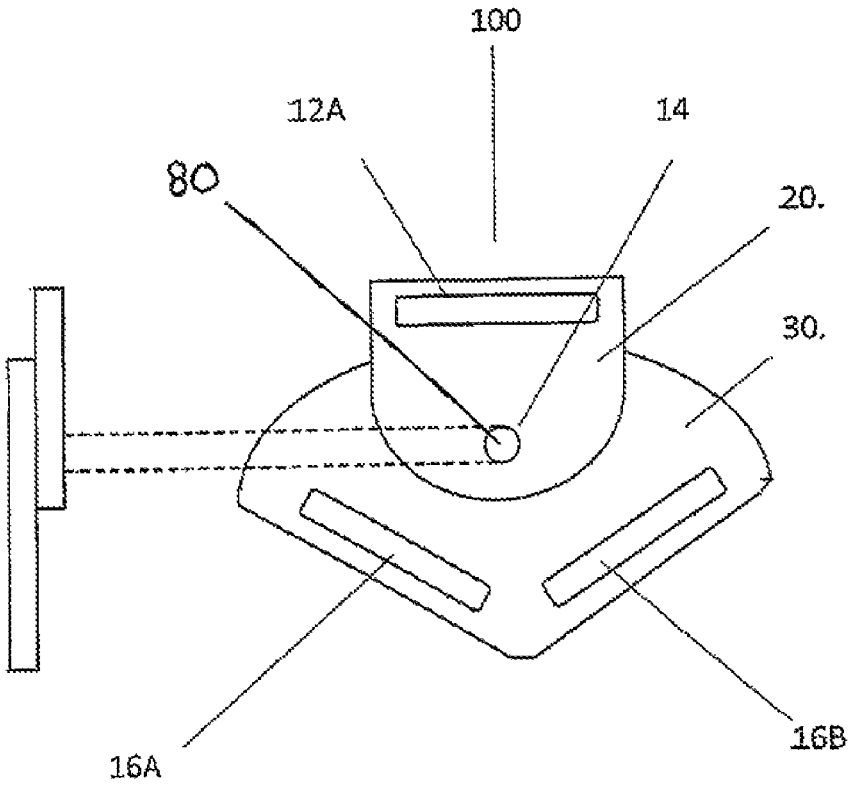
FIG. 2*a* is an exemplary embodiment of a pivotal support plate assembled and positioned at a seventy degree angle.

FIG. 2A illustrates pivotal plate suspension apparatus 100, which is a component of pivotal plate suspension system 100. In the embodiment shown, upper slotted plate 20 is positioned (pivoted) at a ninety degree angle relative to lower slotted plate 30. Angled slots 16A, 16B are visible, as is first aperture 14, and horizontal slot 12A which secures diagonally folded strap 40.

Figure 2B:
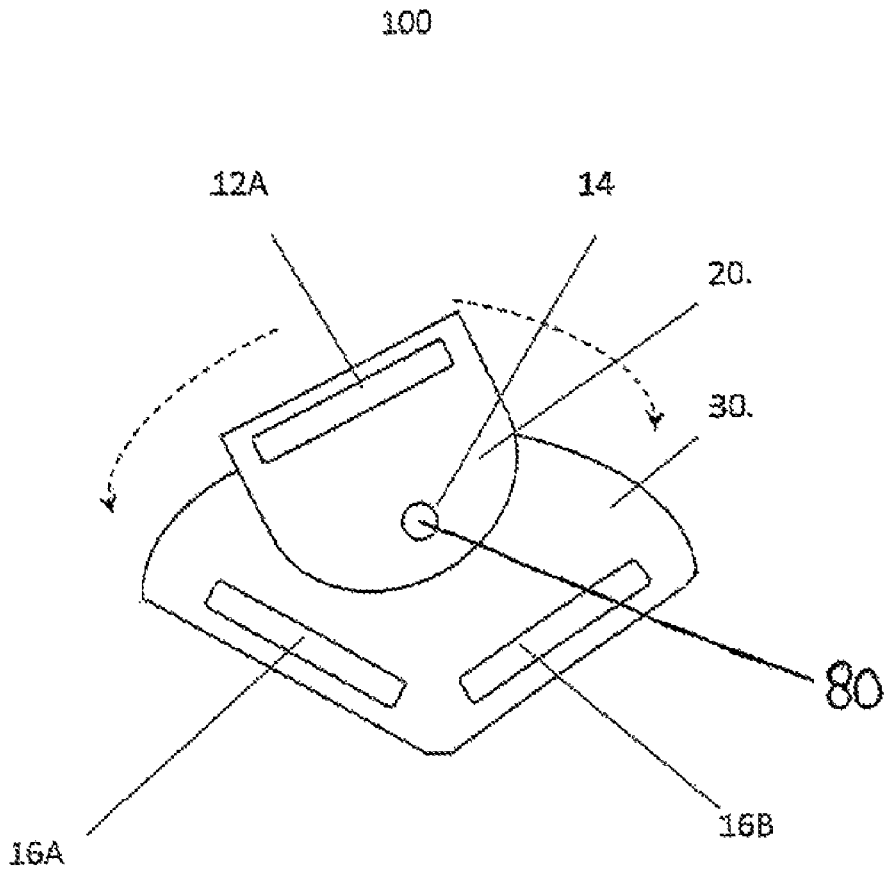
FIG. 2*b* is an exemplary embodiment of a pivotal support plate assembled and positioned at a forty-five degree angle.

FIG. 2B illustrates pivotal plate suspension system 100 pivoted at a forty-five degree angle.

Figure 3:
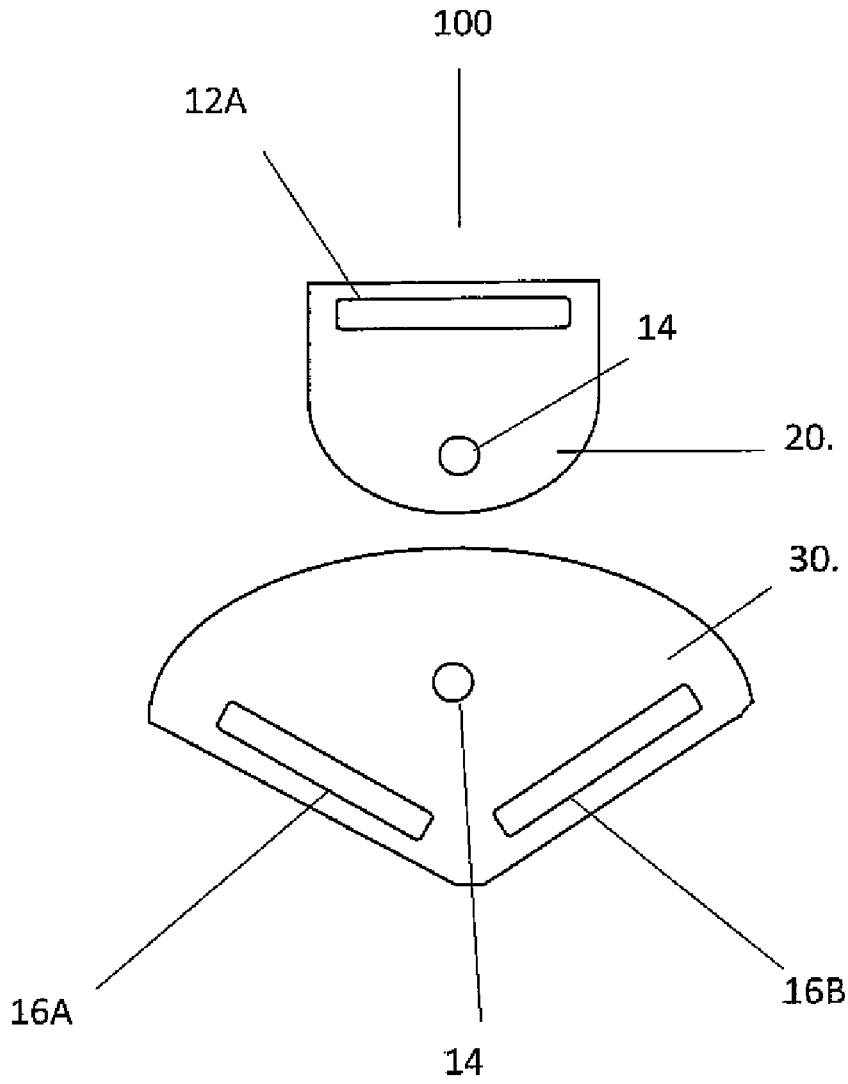
FIG. 3 is an exploded view of an exemplary pivotal support plate.

FIG. 3 is an exploded view of one embodiment of pivotal plate suspension apparatus 100 illustrating the complementary apertures 14 of upper slotted plate 20 and lower slotted plate 30 which are pivotally attached by a rivet (not shown).

What is claimed is:

1. An apparatus to increase range of motion and securely attach suspenders comprised of:

a single centralized pivotal plate assembly comprised of a substantially flat, substantially rigid and friction-resistant upper slotted plate having a horizontal slot and a first aperture adapted to receive a rivet having a shaft of ⅛ to ⅝ inches in length with two heads, and a substantially flat, substantially rigid and friction-resistant lower slotted plate having a triangular shape with a curved upper side and two straight angled sides, two angled slots positioned parallel with said straight angled sides, and a second aperture adapted to receive said rivet and which is pivotally mounted by said rivet to said upper slotted plate, wherein said angled slots are positioned at an angle of 30 to 70 degrees above a horizontal axis, said horizontal axis measured with reference to a horizontal and the center point of said double slotted lower plate, wherein said upper slotted plate overlaps said lower slotted plate such that said horizontal slot does not overlap said lower slotted plate and said upper slotted plated does not cover said two angled slots;

wherein said upper slotted plate is pivotable at a ninety degree angle relative to said lower slotted plate;

a diagonally folded strap inserted within said horizontal slot and having a first upper strap buckle attached at a first end and a second upper strap buckle attached at a second end; and two diagonally folded straps each inserted within one of said two angled slots.

2. The apparatus of claim 1 which further includes a first hook-and-loop fabric strap threaded through said first upper strap buckle and a second hook-and-loop fabric strap threaded through said second upper strap buckle, and said first hook-and-loop strap attached to a first lower strap buckle and said second hook-and-loop fabric strap attached to a second lower strap buckle.

3. The apparatus of claim 2 which further includes a set of elasticized straps threaded through said first and second lower strap buckles, each of said elasticized straps having a clasp attached.

4. The apparatus of claim 3 wherein said elasticized straps are angled.

5. The apparatus of claim 3 wherein said angled slots are angled so that said clasps suspended from said elasticized straps are positioned to be securely attached to securing members attached to clothing.

6. The apparatus of claim 1 wherein said horizontal slot is located within the upper one-third portion of said upper slotted plate.

7. The apparatus of claim 1 wherein said upper slotted plate and said lower slotted plate have substantially smooth surfaces and are constructed of a material selected to minimize friction.

8. The apparatus of claim 7 wherein said material of said upper slotted plate and said lower slotted plate are selected from a group consisting of plastic, nylon, Teflon and plastic coated with a material reduce friction.

9. The apparatus of claim 1 wherein said two diagonally folded straps inserted within said angled slots are elasticized with a clasp attached to each end of said straps and angled so that said clasps are positioned to be securely attached to securing members attached to clothing.

* * * * *